United States Patent [19]

Herner

[11] 4,409,886

[45] Oct. 18, 1983

[54] SELF-RETURNING CYLINDER

[75] Inventor: Ray H. Herner, Brookville, Ohio

[73] Assignee: Mosier Industries, Inc., Brookville, Ohio

[21] Appl. No.: 184,941

[22] Filed: Sep. 8, 1980

[51] Int. Cl.[3] ..... F15B 11/15

[52] U.S. Cl. ..... 91/397; 91/298; 91/319; 91/356; 91/398

[58] Field of Search ..... 91/319, 298, 297, 304, 91/355, 309, 397, 398, 356

[56] References Cited

U.S. PATENT DOCUMENTS

| | | | |
|---|---|---|---|
| 398,930 | 3/1889 | Barth | 91/298 |
| 810,603 | 1/1906 | Badger | 91/298 |
| 964,866 | 7/1910 | Jenner | 91/319 |
| 3,035,548 | 5/1962 | Wittlich | 91/319 |

FOREIGN PATENT DOCUMENTS

| | | | |
|---|---|---|---|
| 2254048 | 7/1974 | Fed. Rep. of Germany | 91/319 |

*Primary Examiner*—Paul E. Maslousky
*Attorney, Agent, or Firm*—Jerome P. Bloom

[57] ABSTRACT

Control apparatus includes means defining a housing having a hollow and a piston device mounted for reciprocating movement in said hollow under the influence of pressure fluid applied alternately to each of opposite portions of its surface, characterized by means for transmitting a signal of a predetermined travel of said piston in one direction, said signal transmitting means being constructed and arranged to utilize applied pressure fluid in its signalling function. A preferred embodiment illustrated includes a rod having one end connected for movement with said piston device and its opposite end projected through and outwardly of said housing to exercise a control function as it projects and retracts in accordance with the movements of said piston device, said signal transmitting means including said rod, at least a portion of said rod having a passage through which applied pressure fluid may pass, at least in one direction of its application, to provide for said signal and a port in said housing arranged to communicate with said passage at a predetermined point of movement of said piston device and said rod in one direction, to provide for issuance of said signal from said housing.

9 Claims, 6 Drawing Figures

SELF-RETURNING CYLINDER

BACKGROUND OF THE INVENTION

This invention provides improvements in the construction of fluid power cylinders enabling such a cylinder to utilize applied pressure fluid to produce a consistently reliable and accurate signal of a given distance and direction of travel of its piston and connected rod. The signal so produced may be variously utilized.

The invention also provides a new method and system for controlling the valve used for cycling pressure fluid to and from a fluid power cylinder which is economical to fabricate, more efficient and satisfactory in use and inherently more reliable than those heretofore employed. It will be described herein in this context, but only by way of illustration and not by way of limitation.

There have, in the past, been fluid power cylinder installations incorporating stroke signalling devices such as reed type switches and special signalling valves. These, however, have not been totally dependable as to their function. It has been found that they are adversely affected by any change in cylinder speed or the back pressure which may exist in the cylinder system in which they are embodied. Such problems are eliminated in the use of embodiments of the present invention.

The invention embodiments afford even greater benefits. Since applied pressure fluid per se may be used to produce signals, component and maintenance requirements are minimized as far as controls are concerned.

SUMMARY OF THE INVENTION

Embodiments of the present invention feature a fluid power cylinder the conventional elements of which are per se adapted to utilize applied pressure fluid to produce a signal of the achievement by its piston and connected rod of a required stroke. In a preferred form of embodiment herein illustrated the signal is initiated by routing a portion of the pressure fluid applied to induce the stroke of the piston and the connected rod in a given direction through a small bore passage provided in the piston and connected rod per se. The signal is actually issued when an outlet from the small bore passage communicates with a signal port in the cylinder housing. As will be seen, the rod is provided with a second small bore passage to evacuate the signalling pressure fluid from the line to which it issues on a reverse cycling of the piston, as an inlet to the second passage communicates with the signal port in the cylinder housing.

The invention also provides an improved means for and method of cycling of fluid power cylinder. In an embodiment herein illustrated in this respect, the signal developed by the described cylinder is employed to automatically function to retract a piston and connected rod to a starting position or a position of rest after it has been projected to the extent necessary to insure its required function. As will be seen, the spool of the valve used to cycle pressure fluid alternately to each of the opposite faces of the cylinder piston is initially positioned by a brief signal operating a control solenoid to route pressure fluid to project the piston and its connected rod to an extent determined by that point at which a signal issues from the cylinder housing. This signal is then employed to automatically cause the valve spool to adjust to produce a return stroke of the piston and the connected rod. The cycling of the piston is consistently within the parameters required. This is inherent in use of the invention features.

Accordingly, it is a primary object of the present invention to provide a fluid power cylinder which is economical to fabricate, more efficient and satisfactory in use and unlikely to malfunction or cause malfunction.

A further object is to provide a fluid power cylinder capable of producing a consistent and accurate signal of the required travel of its piston and connected rod utilizing applied pressure fluid as the signalling medium.

Another object is to provide a fluid power cylinder wherein a portion of the pressure fluid applied to cycle its piston in one direction is routed through its connected rod and caused to exit from the cylinder to signal the achievement of a required stroke of the piston and connected rod in one direction.

An additional object of the invention is to provide an apparatus and system for producing a cycling of the piston and connected rod in a fluid power cylinder wherein the valve for cycling pressure fluid to and from each of the opposite faces of the cylinder piston to produce its strokes is controlled at least in part by a signal produced in the course of the movement of the piston and connected rod the source of which is a portion of the applied pressure fluid.

Another object of the invention is to provide a fluid power cylinder and a system for its application possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein is shown one but obviously not necessarily the only form of embodiment of the invention, FIG. 1 is a sectional view, partially diagrammatic, illustrating a fluid power cylinder embodying features of the present invention;

FIG. 2 diagrammatically illustrates an improved system for control of the cycling of a fluid power cylinder utilizing a cylinder such as illustrated in FIG. 1, particularly illustrating the commencement of the movement of the cylinder piston to produce a projection of its connected rod;

Like parts are indicated by similar characters of reference throughout the several views.

DESCRIPTION OF THE PREFERRED EMBODIMENT ILLUSTRATED

Figure 1:
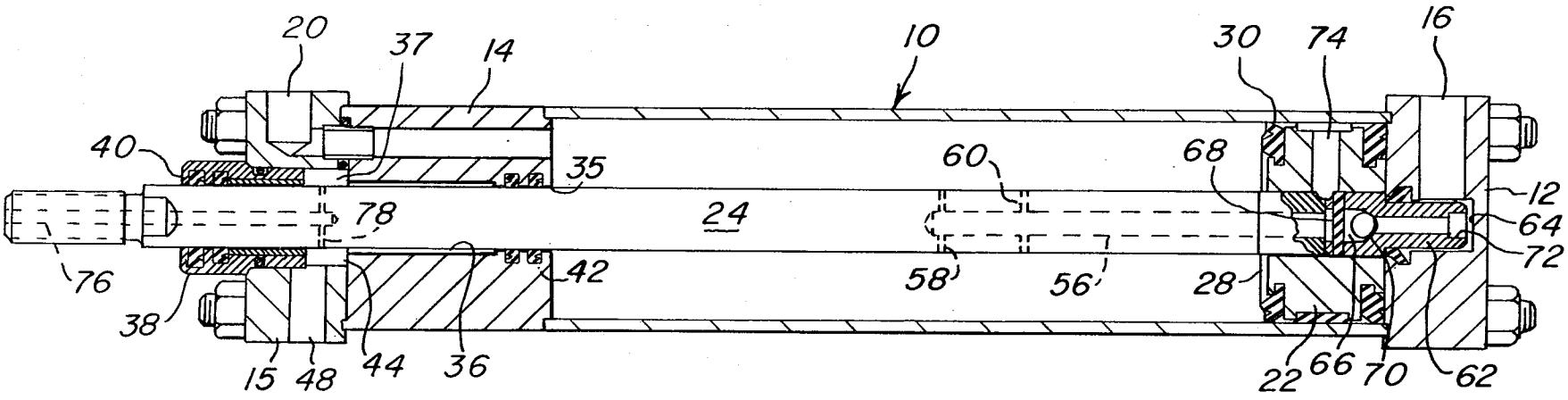
Figure 2:
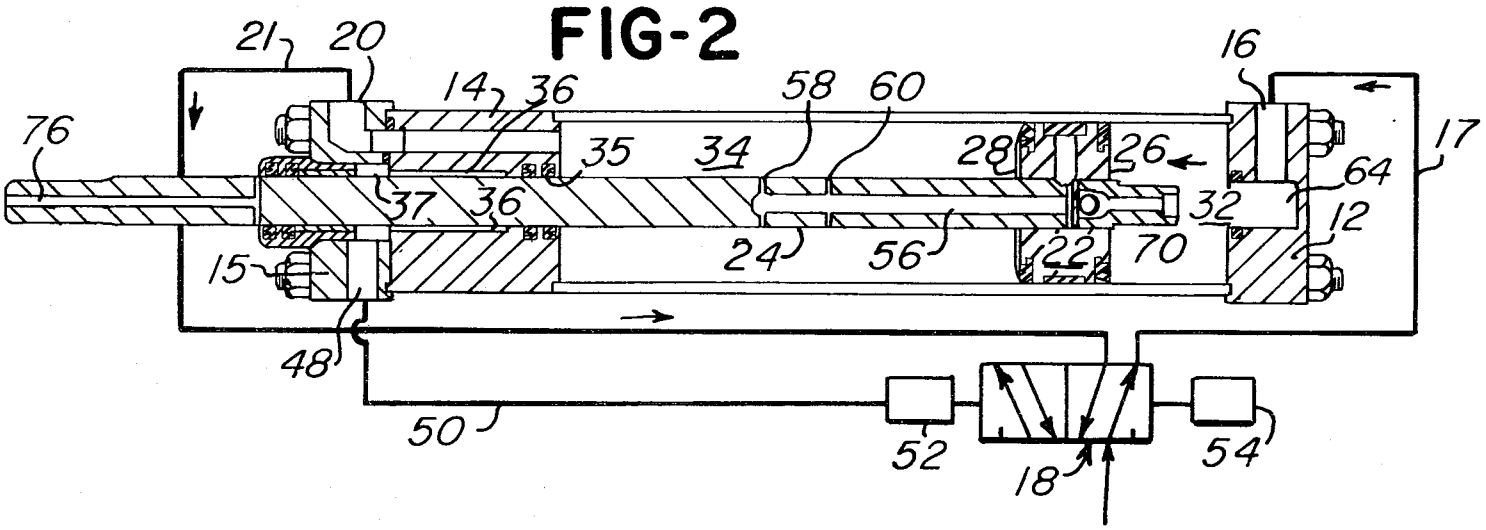
Figure 3:
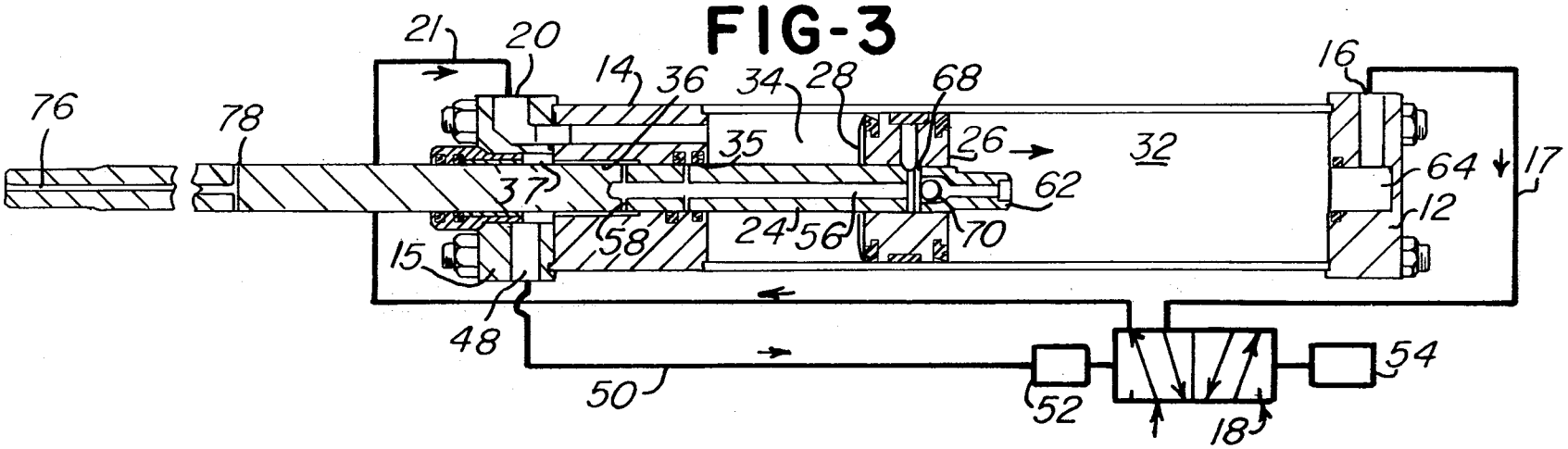
FIG. 3 is a view illustrating the apparatus of FIG. 2 at a point at which the required projection of the piston rod has been completed and a signal thereof issued.
Figure 4:
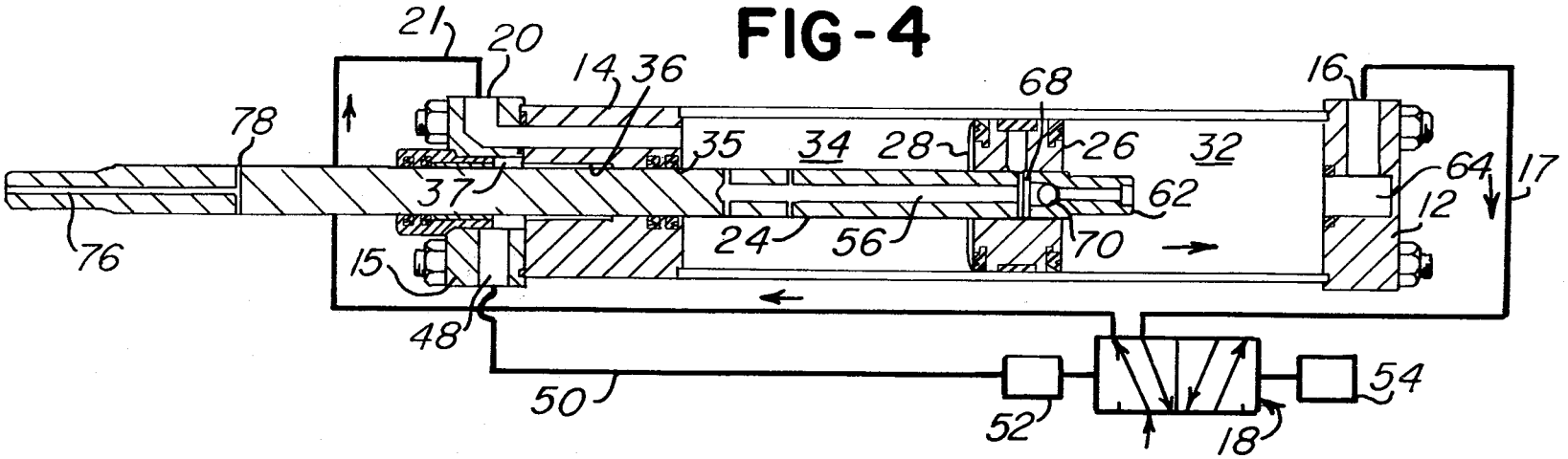
FIG. 4 is a view of the apparatus of FIGS. 2 and 3 illustrating the piston rod in a partially retracted position.
Figure 5:
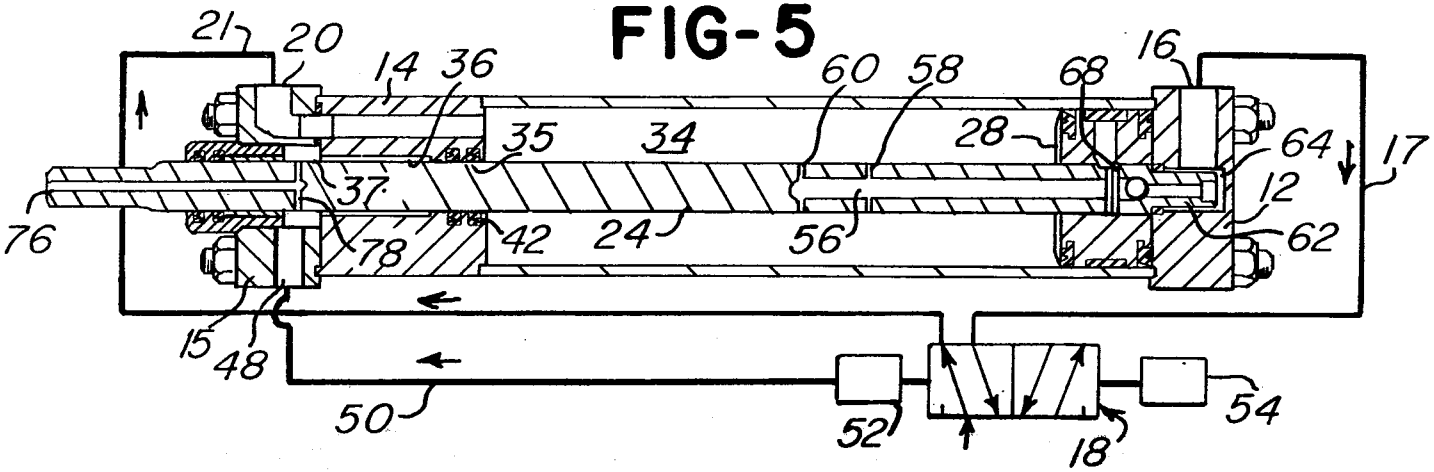
FIG. 5 is an illustration of the same apparatus wherein the piston rod is fully retracted and the previous signal is nullified.

As shown in the drawing, a fluid power cylinder 10 comprises a tube having a head 12 capping its base end and a head 14 capping its operating end. The head 12 has a port 16 coupled to which is a delivery line 17 through which it is arranged to receive operating fluid from a suitable source, by way of a valve 18. The head 14 has a similar port 20 coupled to which is a delivery line 21 through which it is arranged to alternately receive operating fluid from the same source by way of the same valve 18. As is well known in the art, the respective ports and delivery lines likewise serve alternately to exhaust fluid from the cylinder 10.

A piston 22 within and bearing on the inner wall of the cylinder 10 has a central bore within one end of which is threadedly engaged one end of a rod 24, the opposite end of which projects through and outwardly of a coaxial bore 35 in the head 14. As will be seen to this point in the description, the piston 22 responds to application of fluid pressure to either its one face 26 which is adjacent the head 12 or its opposite face 28 from which perpendicularly projects the rod 24, to move in a selected direction in the cylinder 10, thereby to project or retract rod 24.

As schematically illustrated, the piston 22 mounts peripherally positioned and relatively projected resilient ring seals 30 which bear on the inner wall of the cylinder 10 to maintain a seal between it and the piston during reciprocating movements of the piston. During the movements of the piston a chamber 32 is defined to the side thereof adjacent the head 12 and a chamber 34 to the side thereof adjacent the head 14.

The bore 35 has a counterbore 36 directed inwardly of the head 14 from its outermost surface. The head 14 is axially extended by a fixedly attached adapter 15 which also has a central bore 37. The bore 37 produces a coaxial extension of the bore 35 outwardly of its counterbored portion 36. The diameter of the bore 37 is expanded and formed to effectively provide the bore 35 with the equivalent of a second counterbore which is tapped.

As will be seen, to all intents and purposes the adapter 15 and the head 14 which are fixedly connected may be considered for purposes of this disclosure as an integrated structure.

A tubular bearing device 38 is threadedly engaged in the counterbore 37. The innermost end of the device 38 is spaced from the shoulder provided by the counterbore 37 in the composite of the adapter 15 and the end 14 while a flange on the end portion of the device 38 which is outward of the head 14 and its attached adapter abuts tightly to the outermost face of the adapter, in rimming relation to the outermost end of the counterbore 37.

The device 38 thus effectively provides an outward extension of the bore 35. The inner wall thereof mounts ring seals 40 within the axial limits of its outer end portion while its inner end portion provides therein a bearing sleeve for and about the rod 24 as it projects therethrough from the interior of the cylinder 10. Mounted in and projected from that portion of the wall of the bore 35 immediately of the chamber 34 and inward of the counterbore 36 are inboard bearing seals 42 for the rod 24.

The expansion of the bore 35 by the counterbore 36 and the counterbore 37 provides that the bounding walls thereof are spaced radially from and define an annular chamber 44 about the rod 24 as is projects therethrough. The limits of the chamber 44 are provided between the inner end of the device 38 and the inboard bearing portion of the wall of the bore 35 wherein are mounted the inboard bearing seals 42. The adapter portion of the composite of the adapter 15 and head 14 is provided with a radial signal port 48 the innermost end of which opens to the chamber 44 at the location of the counterbore 37 immediately inward of the inner end of the device 38.

In the system illustrated the outermost end of the port 48 opens peripherally of the head-adapter composite 14–15 and has coupled thereto one end of a small bore line 50 the opposite end of which is coupled to a pressure operated pilot 52. The pilot 52 is operatively coupled in turn to one end of the spool of the valve 18, the opposite end of which is operatively coupled to a solenoid 54. Since the nature and character of a conventional fluid cycling valve such as used in connection with fluid power cylinders is well known, this is not specifically illustrated or specifically described. The same applies to the solenoid 54.

Referring now more particularly to the piston rod 24, that end which is coupled in one end of the central bore in the piston 22 is provided with a blind bore 56 directed inwardly of the rod along its central longitudinal axis. The longitudinal extent of the bore 56 will be determined by its application, as will be obvious from the following description. In the case illustrated, the portion of the bore 56 adjacent its innermost or base end is intersected by a first small bore passage 58 located on a diameter of the rod 24 the bore of which is much smaller than that of the blind bore 56. Spaced a short distance from the bore 58 is a second similar bore 60 also arranged transverse to the blind bore 56 and on a diameter of the rod 24. The end of the blind bore 56 which opens from the rod 24 within the piston 22 is axially extended by a tubular valve housing 62 one end of which is threadedly engaged in the central bore in the piston 22, in the end thereof remote from the head 14. The portion of the valve housing 62 which projects outwardly from that face of the piston 22 opposite to that from which the rod 24 projects is relatively reduced in external diameter so that its diameter is less than that of a blind bore 64 provided in alignment therewith in the inner face of the head 12. The bore 64, as may be seen in the drawing, is intersected by the port 16 which opens thereto adjacent its base end. The bore of the housing 62 has a counterbore 66 in the end thereof most adjacent the rod 24 which it abuts. Immediately adjacent and spaced from the end of the housing 62 which abuts the rod 24, the housing 62 has applied therethrough a pin 68 which diametrally bridges the counterbore 66 adjacent the abutted end of the piston rod. Located in the counterbore 66 between the pin 68 and a conically configured shoulder at the innermost end thereof is a ball valving element 70. The ball element 70 is shown in a position to close the bore of the housing 62 in FIG. 1 of the drawings. As may be seen, in this position the ball valving element 70 is spaced from the pin 68 which serves to limit the displacement of the ball valve element 70 from its seat and to prevent its displacement from the valve housing 62 when the ball is displaced to permit passage of fluid through the bore of the housing 62 and into the blind bore 56, as will be further described. The outermost end of the bore of the housing 62 is provided with a counterbore 72 to produce a shoulder in the wall thereof which faces outwardly at the housing and is exposed to the application of pressure fluid when such fluid is delivered into the head 12 by way of the port 16.

Set screw means 74 are commonly applied to the abutted ends of the piston rod 24 and the valve housing 62 to prevent their rotation relative the piston 22. The nature and character of this retention is believed to be adequately demonstrated by the diagrammatic showing in the accompanying drawings.

The end of the rod 24 remote from the piston 22 which in a position of rest of the rod projects outwardly of the device 38 is provided with a blind bore 76 intersected adjacent its base end by a bore 78 of even smaller diameter which is located on a diameter of the rod 24. As will be seen in FIG. 1 of the drawings, in a start or position of rest of the piston and the connected rod 24, the bore 78 communicates the blind bore 76 with the signalling port 48.

Referring to FIGS. 2 through 5 of the drawings, it will be seen that the solenoid 54 may be energized by a suitable momentary signal to position the spool of the valve 18 to direct pressure fluid to the port 16, thereby to apply to the valve housing 62 and to the piston 22 at its face 26 to pressure the piston and connected rod to move away from the head 12 and in the direction of the head 14 of the cylinder 10. At the same time that the pressure fluid applies to the face 26 of the piston a small portion thereof will be metered through the bore of the housing 62 to displace the ball check valve element 70 from its seat and to pass into the blind bore 56 in the adjacent end of the rod 24. At the same time as pressure fluid is applied as described to produce and expand the chamber 32 adjacent the piston face 26, fluid is displaced from the chamber 34, in obvious fashion, to exit from the cylinder by way of the port 20 and exhaust by way of the valve 18. The pressure fluid as here applied is demonstrated to project the rod 24 to serve its operating function. During the projection procedure and until the piston 22 achieves the required distance of travel to produce the necessary length of stroke of the rod 24, the pressure fluid reaching the blind bore 56 will be vented by the bores 58 and 60 to the chamber 34 and exhausted with that fluid exhausted by way of the port 20. The position of the bores 58 and 60 and the chamber about the outer end of the rod communicating with the signal port 48 will be arranged in accordance with the length of the stroke which must be achieved in travel of the piston and its connected rod 24 before a reversing of the stroke takes place. At that point at which the bore 58 communicates with the port 48 by movement into the annular chamber about the rod provided by the counterbore 36, pressure fluid from the blind bore 56 will then be communicated with the port 48 and a signal thereof will be communicated to the pilot 52. The pilot 52 can be conditioned to respond to the signal pressure of the fluid vented from the blind bore by way of the bore 58 alone or together with that vented by the bore 60. In any case, the automatic response of the pilot is to shift the spool of the valve 18. The action in the shifting of the valve spool is to terminate pressure fluid flowing by way of the valve 18 to the port 16 and at the same time to initiate the flow through the valve 18 of the pressure fluid directed thereto from its source to the port 20, thereby to produce a reverse stroke of the piston 22 and its connected rod. As will be seen, the pressure fluid now applied to the face 28 of the piston in the chamber 34 will meter also into the blind bore 56 to reset the check valve element 70 to a position wherein it closes the bore of the valve housing 62, thereby to prevent any interference with the retraction procedure by reason of the pressure fluid reaching the blind bore 56.

Thus, the construction provided utilizes applied pressure fluid to signal the achievement of a predetermined required travel of the piston 22 and the required stroke of the rod 24. The timing of the signal will be consistent and assured in all cases. There can be no signal whatsoever until there is communication of the portion of the pressure fluid reaching the bore 56 with the port 48. This is so whether the cylinder is applied in the system illustrated or whether the signal at the bore 48 introduced by the pressure fluid which is delivered therethrough is used to produce some other function of associated apparatus than that demonstrated or that here illustrated in FIGS. 2 through 5 of the drawings. The signal is thus free of dependence on the speed of the piston movement or any back pressure which might occur in the operation of the cylinder and its parts. One can be sure in the use of the apparatus shown and described that there is certainty that the signal issuing from the cylinder can be depended upon in all cases, irrespective of its application.

Figure 6:
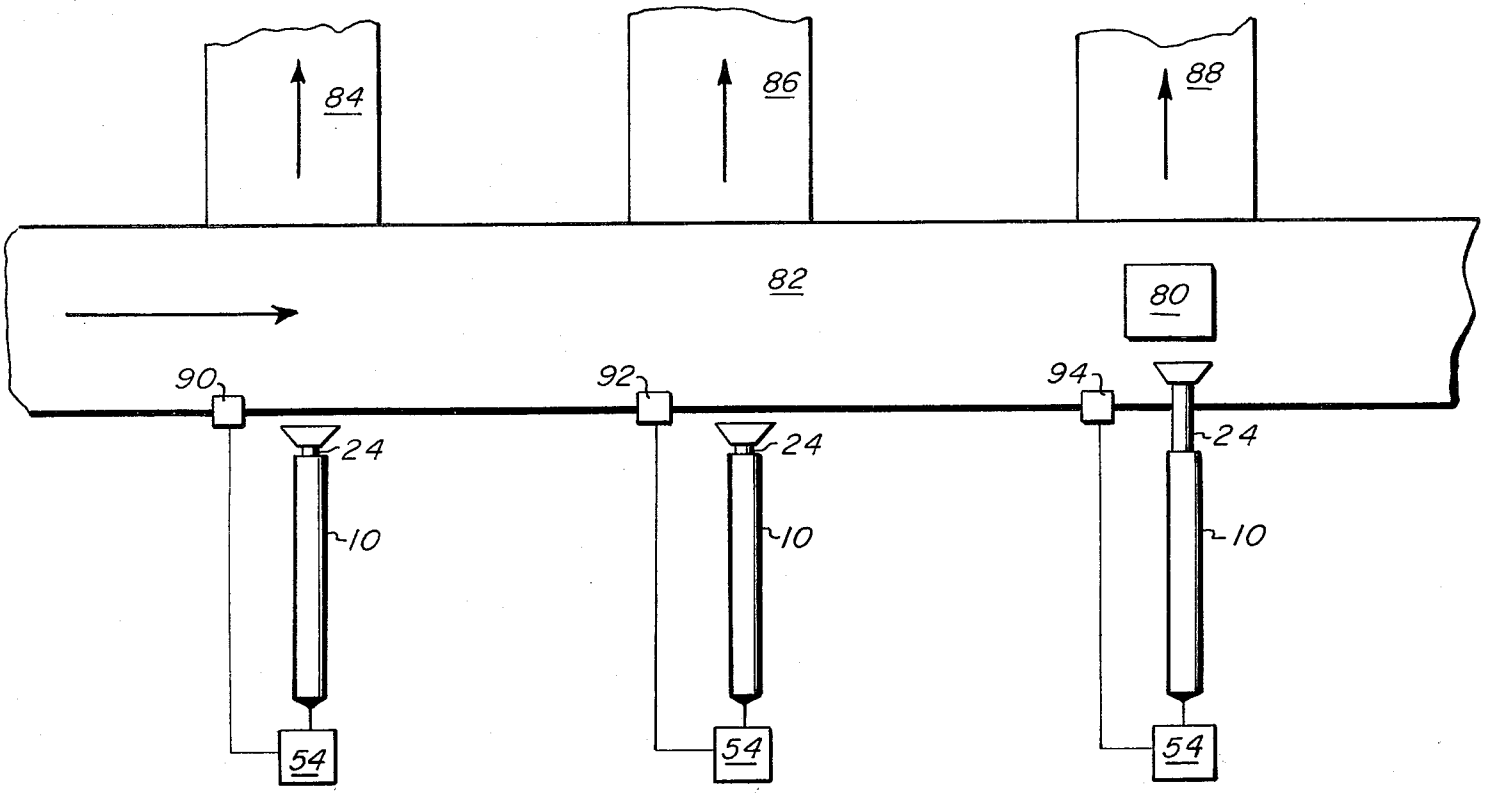
FIG. 6 demonstrates an application of the apparatus and system illustrated in FIGS. 1 through 5 as used in connection with a sorting conveyor system.

Reference is made to FIG. 6 of the drawings which demonstrates an application of the cylinder per the invention as shown and described. In this case, there is illustrated a conveyor system wherein packages 80 of a different nature will be routed down a main conveyor 82 which moves at right angles to branch conveyors diagrammatically illustrated and identified by the numbers 84, 86, and 88 respectively. In this case, as may be seen, there is aligned with each of the branch conveyors a cylinder 10 embodied in a system such as previously described, the respective cylinders having associated with the solenoid thereof a sensing device of any suitable nature which is positioned appropriately to view or otherwise sense packages moving down the main conveyor. These sensors respectively identified by the numerals 90, 92 and 94, respectively associated with conveyors 84, 86 and 88, are designed to select those packages which must be moved down the associated branch conveyor. If a sensor recognizes a particular package which must be moved onto its associated conveyor it will, by necessary circuitry which is provided, send a pulsed signal to energize the solenoid 54 associated with the appropriate fluid power cylinder 10. In the case demonstrated in FIG. 6 of the drawings, the package 80 on the main conveyor 82 is recognized by the sensor 94 associated with the branch conveyor 88, whereupon the solenoid 54 associated with the appropriate cylinder 10 is pulsed momentarily to energize it and to produce as a consequence a shifting of the spool of the related valve 18 to result in an operation demonstrated and described with reference to FIGS. 2 to 5 of the drawings. As will be obvious, the rod 24, in this case having an expanded head applied to its projected extremity, will project to move the package 80 at right angles to its original path on the conveyor 82 and onto the branch conveyor 88. Because of the construction of the cylinder 10 and its use in the invention system, it is insured that the stroke required to displace the package 80 onto the conveyor 88 will be achieved. There can be no malfunction of this conveyor and sorting system in this respect. It should be evident what could occur if the signalling for operation of the cylinder 10 were in accordance with the prior art apparatus which is subject to factors such as speed or back pressure in the cylinder and could accordingly malfunction as to the precise time at which a stroke reversal of the piston and rod of the cylinder should take place. Precision is necessary in a conveying and sorting system such as diagrammatically shown. The advantages and benefits of the invention should be clearly obvious therefrom. Particularly obvious should be the benefits of the construction of a fluid power cylinder to produce a signal of the stroke in a manner as here demonstrated and shown in FIG. 1 of the drawings.

In any case, the invention provides a simple and highly effective control system and apparatus featuring a fluid power cylinder which per se, within its cylinder structure, embodies means for signalling a predetermined travel of its piston and connected rod in one direction to insure against too early a stroke reversal and at the same time to insure a stroke of the piston and connected rod sufficient to achieve its function prior to a full retraction thereof to a starting or rest position.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Control apparatus comprising a piston housed within and in bridging bearing relation to an inner wall surface of a tube, a capping means applied to each of the opposite ends of said tube to form therewith a housing, rod means havng one end thereof in connection with said piston and its opposite end projected through and outwardly of one of said capping means to provide an operating end portion of said rod which locates exterior to said housing, said piston having an inoperative position wherein it is located in an adjacent relation to the other of said capping means, said other of said capping means having an opening for the application therethrough of fluid under pressure to move said piston in the direction of said one capping means, said one end of said rod means having a blind bore therein an inlet opening to which is exposed to the fluid applied to said piston to move it in the direction of said one capping means, said blind bore thereby receiving therein a small portion of said fluid applied under pressure, means defining a signal transmission station in said housing the transmission of a signal through which, governed by a predetermined extent of projection of said operating end of said rod means from said housing in correspondence with the movement of said piston provides in sequence a signal for triggering the flow of fluid under pressure to induce a return movement of said piston to its inoperative position and an evacuation of said signal on said piston reaching its said inoperative position, said blind bore having at least one opening therefrom in a direction inwardly thereof from said inlet opening arranged to communicate, on the achievement of a predetermined extent of movement of said piston in the direction of said one capping means, with said signal transmitting station by way of said one capping means to channel thereto the fluid applied to said blind bore under pressure, for use thereof to produce said signal for triggering the flow of fluid under pressure to induce said return movement of said piston to its inoperative position.

2. Control apparatus as in claim 1 wherein a portion of said rod means at the operating end thereof has a blind bore, a discharge opening from which is provided in the location of the projected extremity thereof and an inlet opening to which is adapted to register with said signal transmission station as said piston reaches its inoperative position to provide for evacuation therethrough of the fluid which has previously provided said signal.

3. Control apparatus as in claim 1 wherein said blind bore embodies means defining a one way valve to pass fluid under pressure applied therein in the moving of said piston, and said rod means, in the direction of said one capping means and to close the blind bore to prevent reverse movement of fluid therethrough during a return of said piston to its inoperative position.

4. Control apparatus comprising a piston housed within and in bridging bearing relation to an inner wall surface of a tube, a capping means applied to each of the opposite ends of said tube to form therewith a housing, rod means having one end in connection with said piston and its opposite end projected through and outwardly of one of said capping means to provide an operating end of said rod means, said piston having an inoperative position wherein it is located in an adjacent relation to the other of said capping means, said other of said capping means having an opening for the application therethrough of fluid under pressure to move said piston in the direction of said one capping means, said one end of said rod means having an extension thereof beyond said piston, in the direction of said other of said capping means, and embodying therein a blind bore and in said inoperative position of said piston said extension of said rod means projecting inwardly of a bore providing part of said opening in said other of said capping means to position means defining the inlet opening to said blind bore in the path of such fluid as is delivered to move said piston in the direction of said one capping means, said blind bore thereby receiving therein a portion of said fluid applied under pressure in the process of which to initiate the movement of said rod means and correspondingly said piston, said blind bore having an opening for discharge of said fluid therefrom to the interior of said tube, said rod means being in bearing relation to said one capping means as it projects therethrough, means defining a passage about a portion of said rod means, said passage being in communication with a signal transmission station in said housing in the area of said one capping means, said opening for discharge of fluid from said blind bore being placed in communication with said passage on the movement of said piston in the direction of said one capping means to a position corresponding to the occurrence of a predetermined projection of said rod means to direct said fluid discharging from said blind bore to said signal tranmission station and produce thereby a signal for triggering a flow of fluid under pressure to induce a return movement of said piston to its inoperative position.

5. Control apparatus comprising a piston housed within and in bridging bearing relation to an inner wall surface of a tube, a capping means applied to each of the opposite ends of said tube to form therewith a housing, rod means having one end in connection with said piston and its opposite end projected through and outwardly of one of said capping means to provide an operating end of said rod means exterior to said housing, said piston having an inoperative position wherein it is located in an adjacent relation to the other of said capping means, said other of said capping means having an opening for the application therethrough of fluid under pressure to move said piston in the direction of said one capping means and means defining a signal transmission station at said one of said capping means the transmission of a signal through which, governed by a predetermined extent of projection of said operating end of said rod means from said housing in correspondence with movement of said piston, provides in sequence a signal for triggering a flow of liquid under pressure to induce a return movement of said piston to its inoperative position and for an evacuation of said signal on said piston reaching its said inoperative position, said signal being produced by the direction through and from a blind bore in said rod means of a portion of the fluid applied under pressure to move said piston and said rod means in connection therewith in the direction of said one capping means at a point in time that there is a specific extent of projection of the operating end portion of said rod means from said housing.

6. Control apparatus comprising a piston housed within and in bridging relation to an inner wall surface of a tube, a capping means applied to each of the opposite ends of said tube to form therewith a housing, rod means having one end in connection with said piston and its opposite end projected outwardly of one of said capping means, said piston having an inoperative position wherein it is located in an adjacent relation to the other of said capping means, said other of said capping means having an opening for the application therethrough of fluid under pressure to move said piston in the direction of said one capping means, said one of said capping means having an opening therein for fluid to pass therethrough and enter the interior of said tube under pressure to move said piston toward the other of said capping means and for receiving a pressured flow of fluid induced to move therethrough by said piston as it moves in the direction thereof, said opening in said other of said capping means serving for discharge from said tube of such fluid as is in the path of said piston in the return thereof to its said inoperative position, a valve for selectively directing fluid under pressure to or receiving fluid from the interior of said tube by way of said openings in said capping means, control means separated from the movement of said fluid and operable independently thereof for conditioning said valve to direct fluid under pressure to said opening in said other of said capping means to move said piston means in the direction of said one capping means, means defining a signal transmission station in said housing the transmission of a signal through which is governed by a predetermined extent of projection of said opposite end of said rod means from said housing in correspondence with the movement of said piston, and means providing that said signal is applied to condition said valve to direct fluid to and through said opening of said one of said capping means, under pressure to induce the return movement of said piston to its said inoperative position and to also provide a path for removal of said signal to free said valve for conditioning thereof by said control means for initiating a subsequent cycle of the movement of said piston means and said rod in connection therewith.

7. Control apparatus comprising a piston housed within and in a bridging bearing relation to an inner wall surface of a tube, a head applied to each of the opposite ends of said tube to form therewith a housing, rod means having one end in connection with and its opposite end projecting from said piston, said opposite end being projected through and outwardly of one of said heads, said piston having one position wherein it is located in an adjacent relation to the other of said heads, which has an opening for the application therethrough of fluid under pressure to move said piston in the direction of said one head, said one of said heads also having an opening for application therethrough of fluid under pressure to apply to said piston to move it in the direction of said other of said heads, said openings serving also as exhaust openings for discharge of fluid originally directed therethrough into said tube, a control valve through the medium of which fluid under pressure is selectively directed to one or the other of said openings in said heads, a control device for applying a signal to said valve, with said piston in its said one position, to condition said valve to direct fluid under pressure through said opening in said other of said heads to move said piston and the rod in connection therewith in the direction of said one head, means defining a signal transmission station a signal through which, governed by a predetermined extent of projection of said opposite end of said rod means from said housing in correspondence with a predetermined extent of the movement of said piston, is applied to condition said valve means to terminate the flow of fluid under pressure to said opening in said other of said heads and provide for a flow of fluid under pressure through the opening in said one of said heads to induce a return movement of said piston to its said one position and means provided for evacuation of said signal transmitted through said signal transmission station to condition said valve for reception of a further signal from said control device on said piston reaching its said one position.

8. Control apparatus comprising a tube, a head applied to each end of said tube to define therewith a housing, each said head having a passage therein for selectively introducing therethrough fluid to the adjacent end of the tube, under pressure, rod means having one end thereof projected through and in bearing relation to one of said heads and its opposite end projected to the interior of said housing, said rod means mounting a piston to move therewith in an area within and in a bearing, bridging relation to an inner wall surface of said tube, one of said heads having therein a chamber which is separate and apart from said passage therein, said rod means having a small bore in a limited portion of its length arranged to receive therein a small amount of the fluid applied to the interior of said tube to one side of said piston by way of said passage in said other of said heads to move said piston and said rod means therewith in the direction of said one of said heads, said passage in said one of said heads serving in this process to exhaust fluid from said tube which is in the path of the movement of said piston in the direction of said one of said heads, said bore in said rod means being arranged to communicate with said chamber in said one of said heads, upon said piston reaching a location within said tube corresponding to the achievement of a certain degree of projection of said one end of said rod means outwardly of said one of said heads, to deliver to and through said chamber the pressure fluid introduced to said bore, means for directing the pressure fluid reaching said chamber to trigger an application of fluid under pressure through said passage in said one of said heads to reverse the direction of movement of said piston while the passage in said other of said heads accommodates an exhaust of the fluid in the path of said piston as it moves toward said other of said heads, the construction and arrangement providing for a maintenance of the application of said triggering fluid in its triggering mode until said piston has been moved to a predetermined point in the direction of its travel toward said other of said heads.

9. Control apparatus as in claim 8 including means operative to provide an evacuation of said fluid providing said signal.

* * * * *

UNITED STATES PATENT AND TRADEMARK OFFICE

CERTIFICATE OF CORRECTION

PATENT NO. : 4,409,886

DATED : October 18, 1983

INVENTOR(S) : Ray H. Herner

It is certified that error appears in the above—identified patent and that said Letters Patent is hereby corrected as shown below:

Col. 1, line 53, "of" (second occurrence) is corrected to read -- a --.

Col. 3, line 65, "is" is corrected to read -- it --.

Col. 7, line 42 (Claim 1, line 5) "havng" is corrected to read -- having --.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*